US005799864A

United States Patent [19]

Mertz

[11] Patent Number: 5,799,864

[45] Date of Patent: Sep. 1, 1998

[54] CONTAINER CLOSURE ARRANGEMENT

[75] Inventor: Noel J. Mertz, Ballwin, Mo.

[73] Assignee: Jefferson Smurfit Corporation, Clayton, Mo.

[21] Appl. No.: 889,897

[22] Filed: Jul. 8, 1997

[51] Int. Cl.[6] ..... B65D 5/30

[52] U.S. Cl. ..... 229/196; 229/149; 229/177

[58] Field of Search ..... 229/149, 177, 229/196, 902, 906

[56] References Cited

U.S. PATENT DOCUMENTS

| | | | |
|---|---|---|---|
| 262,201 | 8/1882 | Bowe | 229/196 |
| 684,929 | 10/1901 | Golberg | 229/196 |
| 2,522,598 | 9/1950 | Blandford | 229/196 |
| 2,789,750 | 4/1957 | Kramer | 229/196 |
| 3,708,103 | 1/1973 | Evans | 229/196 |
| 5,209,392 | 5/1993 | Anatro | 229/906 |

*Primary Examiner*—Gary E. Elkins

*Attorney, Agent, or Firm*—Richard W. Carpenter; Robert J. Black

[57] ABSTRACT

A closure arrangement for a one-piece, foldable, paperboard container with tray and hinged cover, the tray side wall panels have, foldably joined to their front edges, corner flaps adapted to lie against the inner surface of the tray front wall, and each of the corner flaps are scored to allow a portion of the flap to be deflected, as its related side wall panel is canted inwardly, to facilitate insertion of lock tabs projecting upwardly and downwardly from the corner flaps into related receiving openings of the tray top panel and bottom wall panel.

20 Claims, 4 Drawing Sheets

CONTAINER CLOSURE ARRANGEMENT

BACKGROUND OF THE INVENTION

1. Field of the Invention

This invention relates to paperboard containers of the type used for the packaging of pizza and similar products, and more particularly to an improved corner construction for a closure arrangement in a container that includes a relatively shallow depth tray with a hinged cover.

2. Description of the Background Art

A background art search directed to the subject matter of this invention conducted in the U.S. Patent and Trademark Office disclosed the following U.S. Letters Patent: 4,058,249 4,418,863 4,860,948 4,883,221 5,375,762

None of the patents uncovered in the search discloses a closure arrangement for a paperboard container that includes a relatively shallow depth tray with hinged cover, wherein the tray side wall panels have, foldably joined to the front ends thereof, front corner flaps with upper and lower lock tabs projecting upwardly and downwardly from upper and lower edges thereof which are adapted for interlocking engagement with recesses in the tray top and bottom wall panels to secure the side wall panels to the front wall panel, and wherein the corner flaps have laterally extending scores therein to facilitate assembly of the tray.

SUMMARY OF THE INVENTION

It is a primary object of the invention to provide an improved closure arrangement for a paperboard container that includes a tray with a hinged cover.

Another object of the invention is to provide a container of the type described that can be made from a minimum amount of sheet material such as paperboard.

Yet another object of the invention is the provision of a tray type container with hinged cover, wherein the tray can be readily erected and maintained in the open position to allow a person to use both hands to fill the container and lock the cover in place.

A more specific object of the invention is to provide a closure arrangement for a paperboard container wherein the tray side wall panels have, foldably joined to the front ends thereof, front corner flaps with upper and lower lock tabs projecting upwardly and downwardly from upper and lower edges thereof which are adapted for interlocking engagement with recesses in the tray top and bottom wall panels to secure the side wall panels to the front wall panel, and wherein the corner flaps have laterally extending scores therein to facilitate assembly of the tray.

These and other objects of the invention will be apparent from an examination of the following description and drawings.

It will be understood that, for purposes of clarity, certain elements may have been omitted from certain views where they are believed to be illustrated to better advantage in other views.

DESCRIPTION OF THE PREFERRED EMBODIMENT

Figure 1:
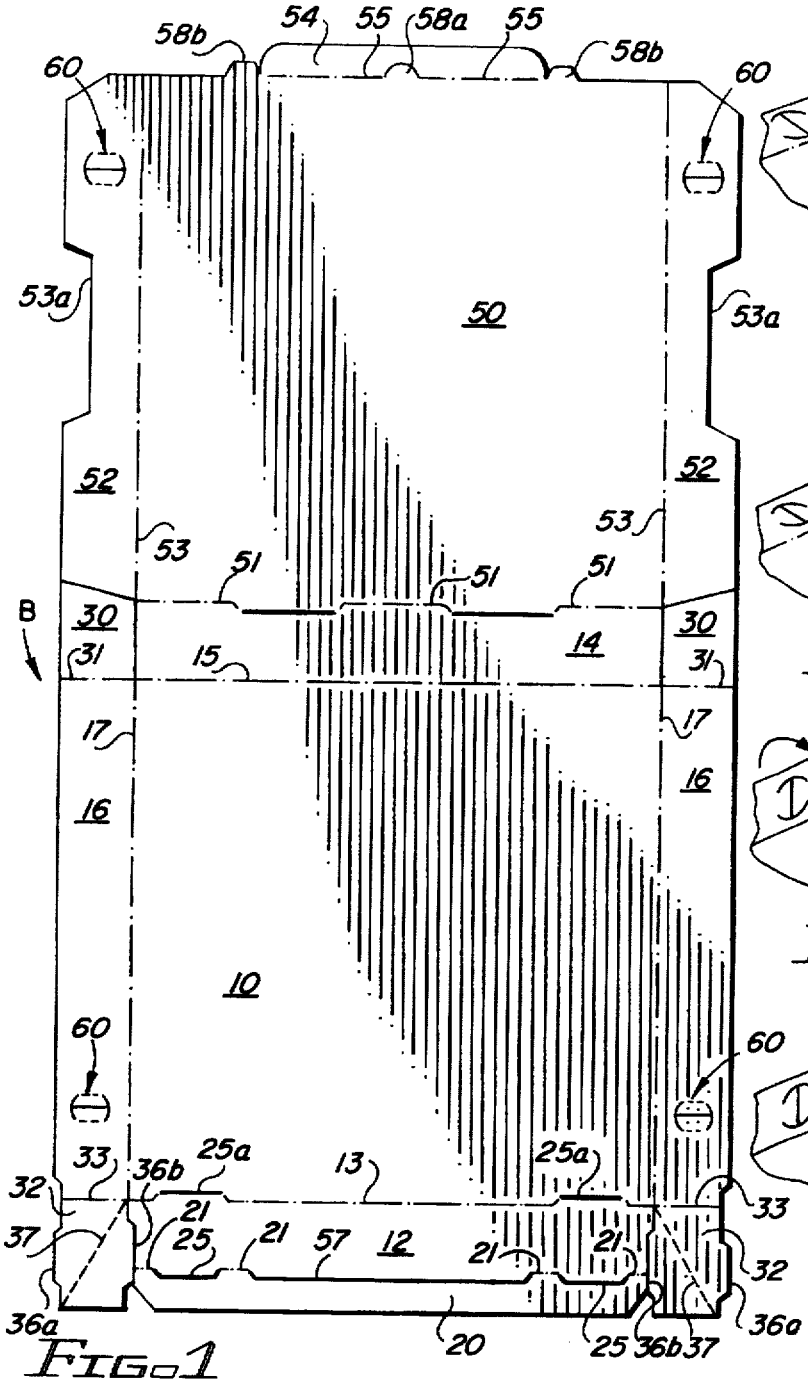
FIG. 1 is a top plan view of a blank of foldable sheet material from which the container illustrated in the other views may be formed.
Figure 4A:
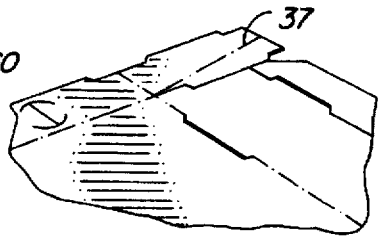
FIGS. 4A through 4F are isometric views illustrating the specific steps involved in erecting the front corner structures of the container shown in FIGS. 2A through 2H.
Figure 4B:
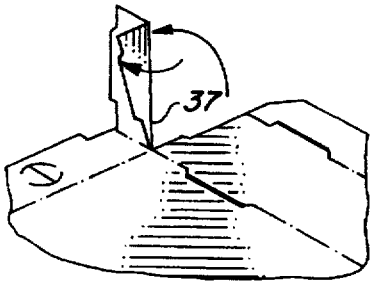
Figure 4C:
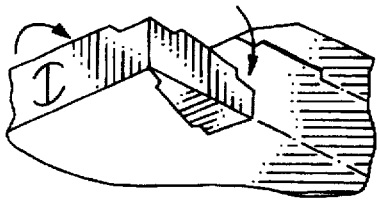
Figure 4D:
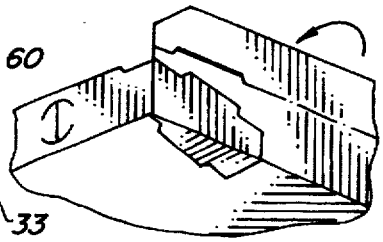
Figure 4F:
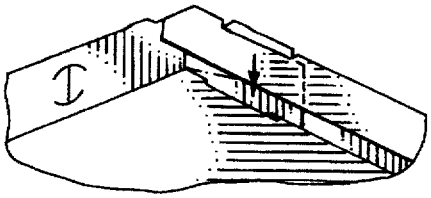
Figure 4E:
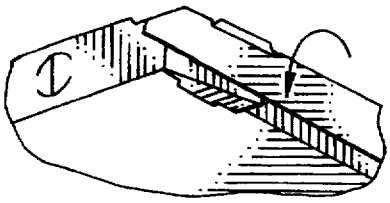
Figure 2A:
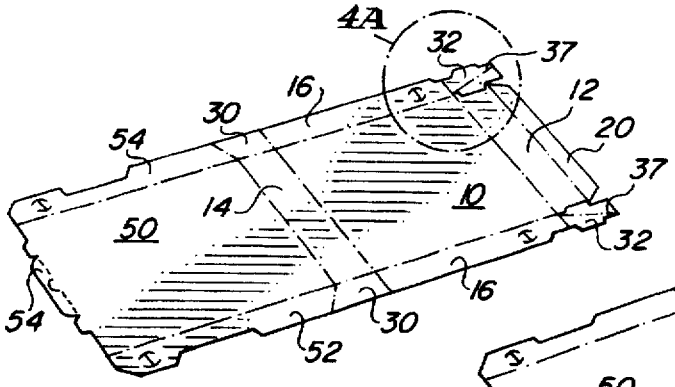
FIGS. 2A through 2H are isometric views illustrating the steps involved in erecting the container from the blank shown in FIG. 1.
Figure 2B:
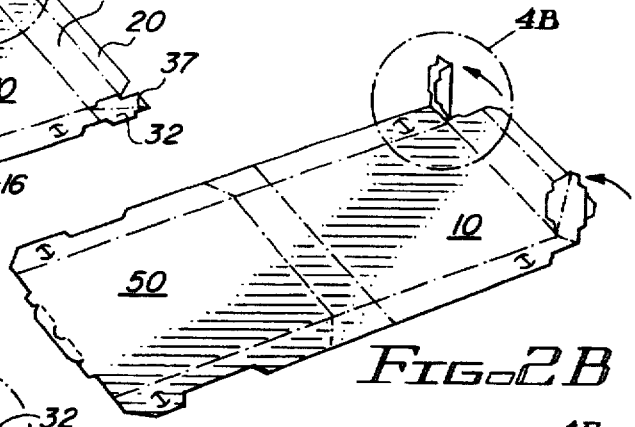
Figure 2C:
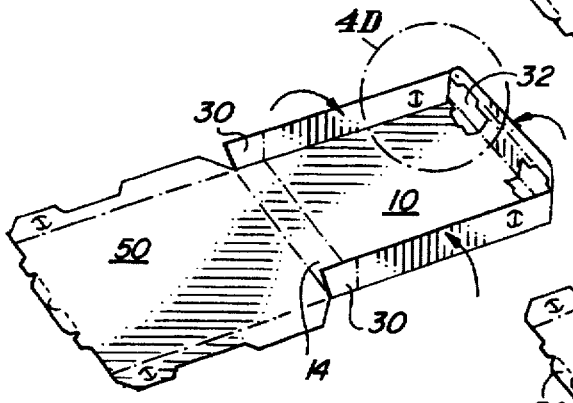
Figure 2D:
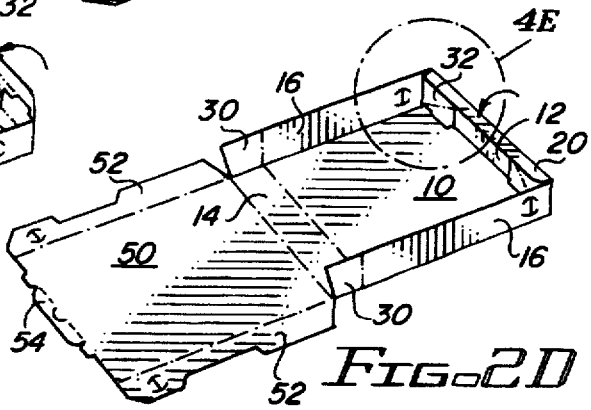
Figure 2E:
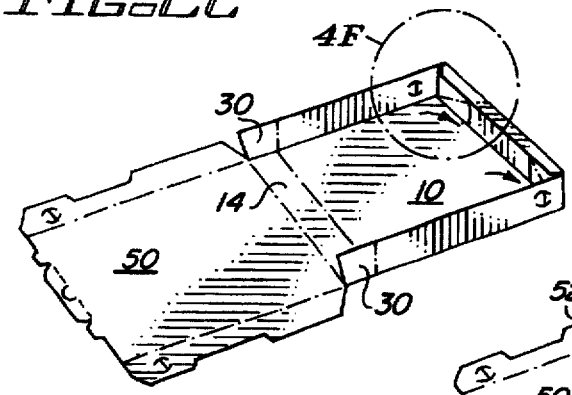
Figure 2F:
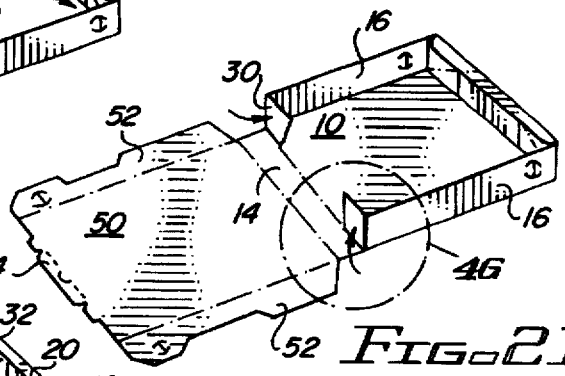
Figure 2G:
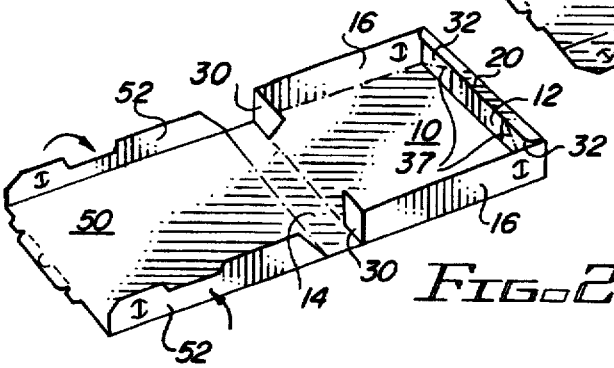
Figure 2H:
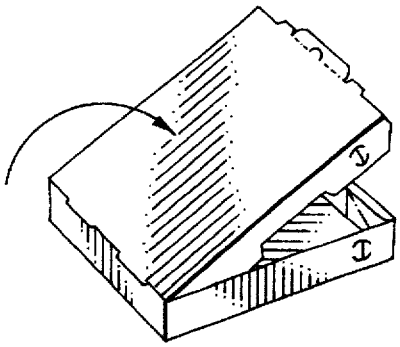
Figure 2I:
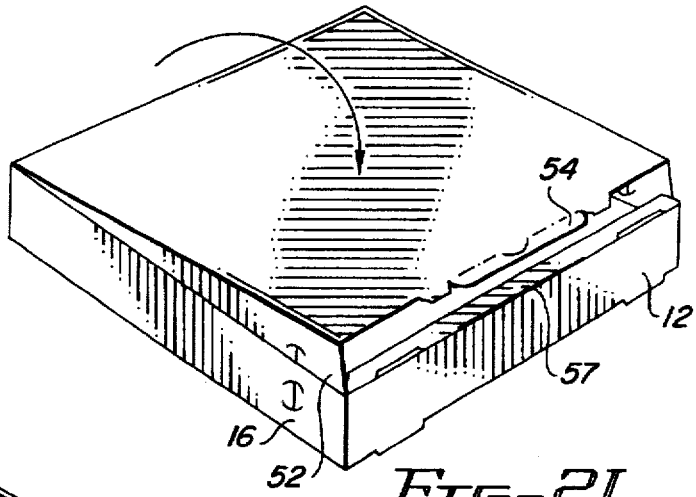
FIGS. 2I through 2K are isometric views illustrating the steps involved in closing the container cover.
Figure 2J:
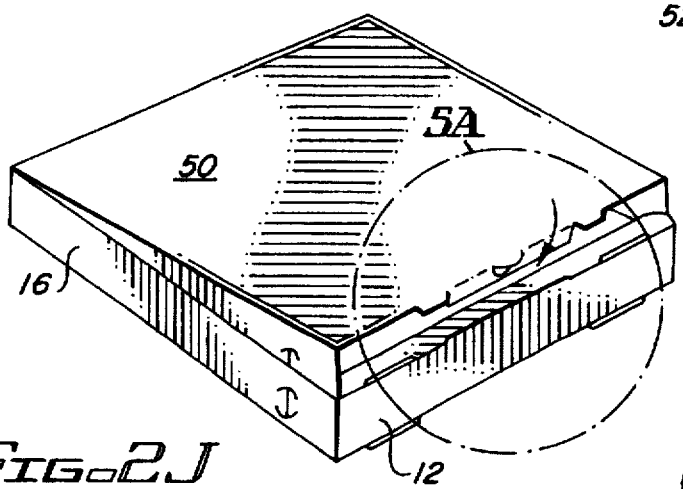
Figure 2K:
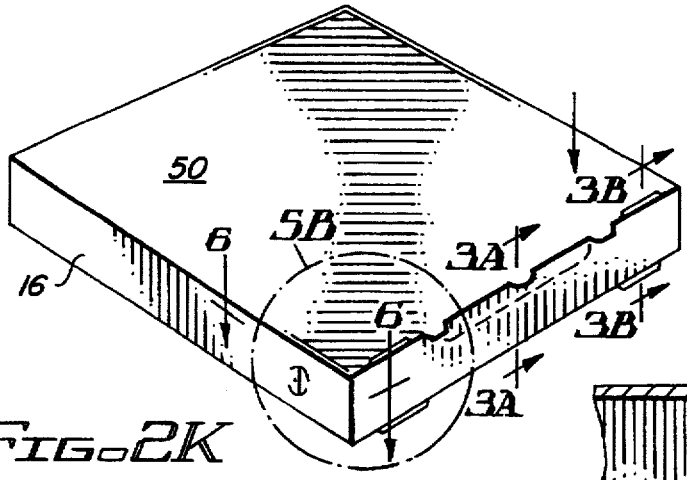
Figure 5A:
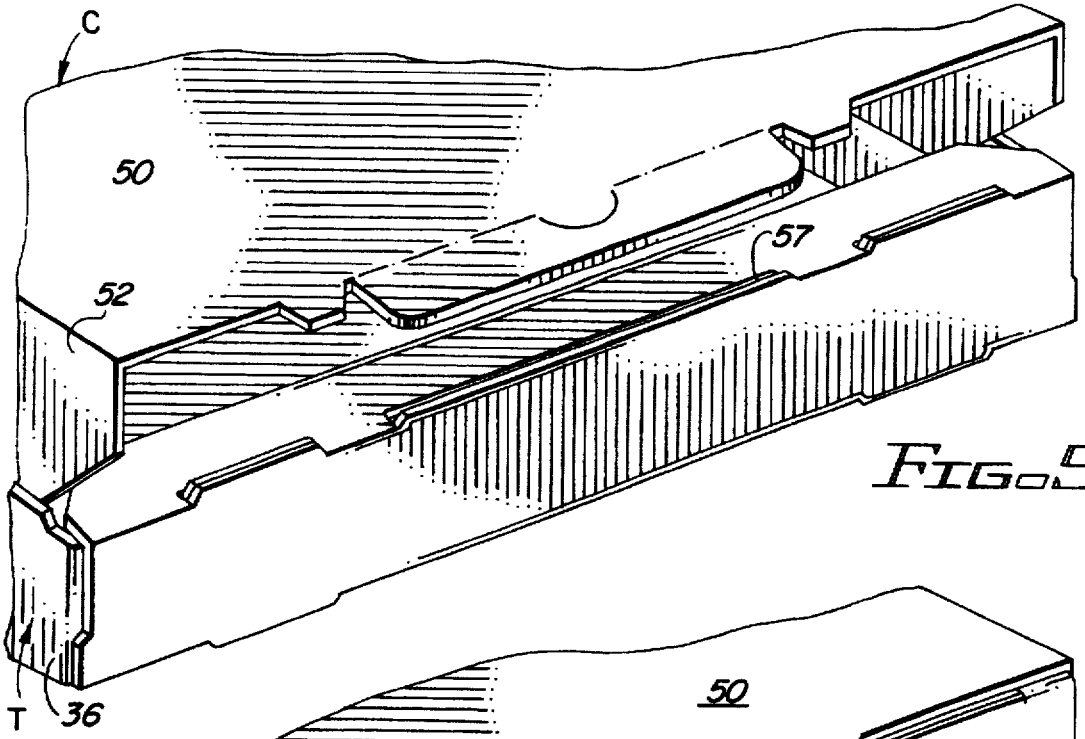
FIG. 5 is a partial isometric view of the closed container structure illustrated in FIGS. 2G and 2H, as seen from the front.

Referring now to the drawings for a better understanding of the invention, it will be seen that the container embodying features of the present invention and identified at C in FIGS. 2G, 2H, and 5A, can be formed from the unitary blank of foldable sheet material, such as paperboard, indicated at B in FIG. 1.

Container C is a shallow depth folder of the type commonly used for the packaging of pizza and similar products and includes a tray T and an integral hinged cover K.

As best seen in FIG. 1, the tray includes a generally rectangular bottom wall panel 10 having a front wall panel 12, a rear wall panel 14, and a pair of side wall panels 16 foldably joined to front, rear, and side edges thereof along fold lines 13, 15, and 17, respectively, and upstanding therefrom.

A relatively narrow, elongated, top panel 20 is foldably joined at its front edge, along fold line 21, to the upper edge of tray front wall panel 12 and is disposed to extend rearwardly from the front wall panel.

Still referring now to FIG. 1, it will be seen that tray side wall panels 16 each have foldably joined to their rear and front edges, along fold lines 31 and 33, rear and front corner flaps 30 and 32, respectively, which are folded inwardly at right angles to the side wall panels when the container is erected.

As best seen in FIG. 1, each of the tray front corner flaps 32 has, projecting upwardly and downwardly from its upper and lower edges, upper and lower lock tabs **36*a* and 36*b***, respectively.

Tray top panel 20 has extending therethrough a pair of lock tab receiving slots formed by cut lines 25, which are located inwardly adjacent opposite ends of the top panel and adjacent fold line 21, which joins the top panel 20 to tray front wall panel 12.

Tray bottom wall panel 10 also has extending therethrough a pair of lock tab receiving slots, formed by cut lines **25*a***.

The purpose of the slots in the top panel and the bottom wall panel is to receive and retain side wall panel front corner flap upper and lower lock tabs **36*a* and 36*b***.

As best seen in FIG. 1, each tray side wall panel front corner flap 32 has, extending laterally across a lower portion thereof at a slight angle, a score line 37. The purpose of the score lines is to allow the corner flaps to bend to facilitate erecting of the container, as described hereinafter.

As best seen in FIG. 1, the hinged cover includes a top wall panel 50, foldably joined at its rear edge along a fold line 51 to the upper edge of tray rear wall panel 14, and a pair of side wall panels 52, foldably joined along fold lines 53 to opposed side edges of top wall panel 50, and depending therefrom. Panels 52 each may have, in a lower edge, a centrally located recess **53*a***.

Cover K may be provided with a relatively narrow tuck flap 54 foldably joined, along a fold line 55, to the center of the front edge of top wall panel 50. When the container has been erected and the cover closed, tuck flap may be folded downwardly and inserted into a tuck flap receiving slot formed by a cut line 57 in the tray top panel 20 to lock the cover on the tray in closed position.

Figure 5B:
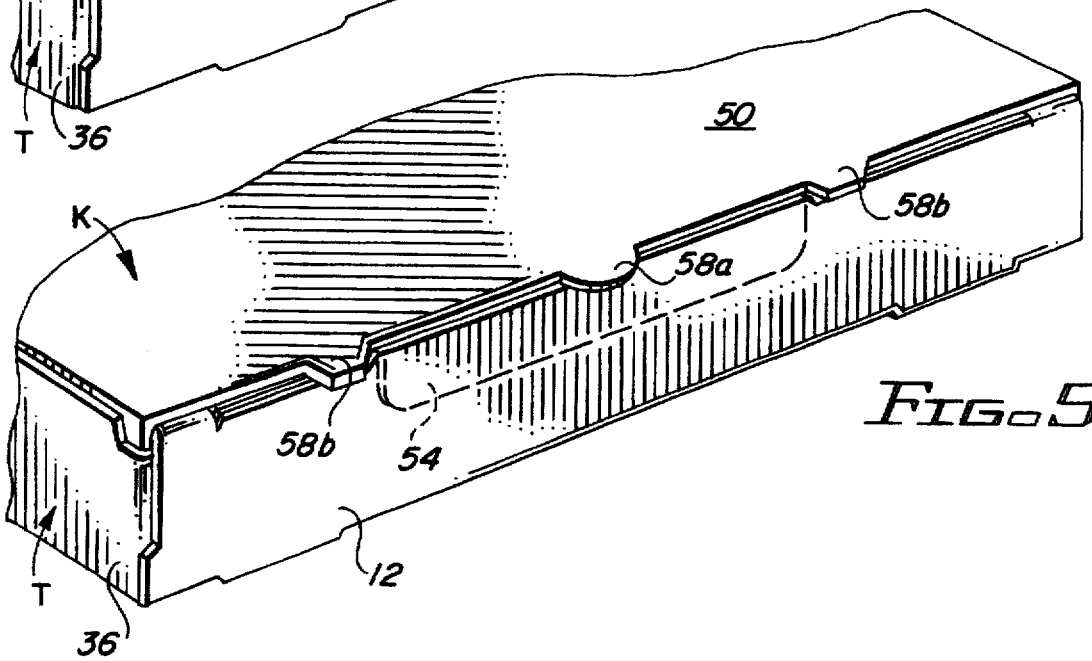
Figure 6:
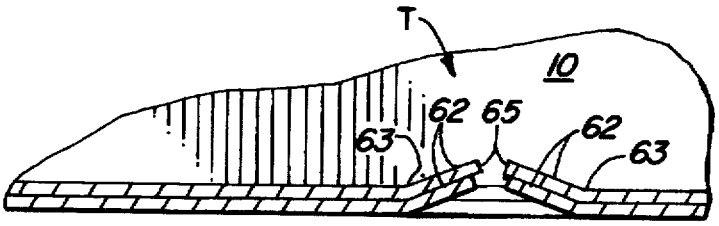
FIG. 6 is a horizontal sectional view taken on line 6—6 of FIG. 2K.

Also, as best seen in FIG. 5B, cover top wall 50 may be provided with a center tab 58*a* and a pair of side tabs 58*b* that project forwardly from the front edge of the cover top wall panel.

When the container is erected, center tab 58*a* and side tabs 58*b* are received in tray front wall center recess and in a pair of side recesses.

An alternate means of locking the cover K to the tray T may be provided in the form of side wall panel locking means indicated generally at 60 as seen in FIG. 1.

Figure 3B:
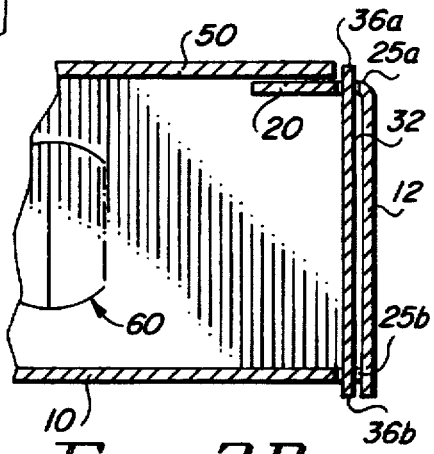
FIG. 3 is a vertical sectional view taken on line 3—3 of FIG. 2G.
Figure 3A:
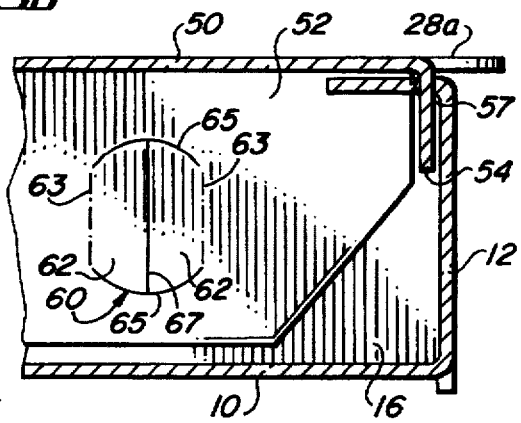

Locking means 60, as best seen in FIGS. 1 and 3A, include a pair of lock tabs 62 in each of the tray and cover side wall panels. Each pair of lock tabs 62 are foldably joined to their related side wall panels on fold lines 63. The tabs 62 are defined by upper and lower horizontal cut lines 65, and are separated from each other by a vertical cut line 67.

After the container has been erected, the side wall panels of the tray can be interlocked with the side wall panels of the cover by pushing each set of tray side wall panel lock tabs into the openings formed by the tabs of the cover side wall panels.

The tray may be manually erected easily and quickly as shown in FIGS. 2A–2H by folding the tray front, rear, and side wall panels 12, 14, and 16 upwardly at right angles to the tray bottom wall panel 10, with the front and rear corner flaps, 32 and 30, folded inwardly against the inside surfaces of the front and rear wall panels, respectively. As previously mentioned, the angle score 37 in the front corner flaps allows the corner flaps to be deflected, so they can be pushed snugly against the tray front wall panel with the upper and lower lock tabs 36*a* and 36*b* aligned with tray top wall lock tab receiving slots 25. The portion of each front corner flap between score line 37, which allows the corner flap to be bent to facilitate insertion of the corner flap upper and lower lock tabs into the related slots of the tray top panel and bottom wall panel.

It should be noted that it is necessary to articulate tray side wall panels 16 past 90 degrees in order to move the corner flap upper lock tabs 36*a* into the related tab receiving slots 25.

Once the tray is erected and locked in erected condition, both of the operator's hands are free to fill and close the container.

After the tray has been filled with product, cover top wall panel 50 is folded at right angles to the tray rear and front wall panels 16 and 12, respectively, to overlie the tray top panel 20, with the cover side wall panels 52 positioned inside the tray side wall panels 16.

The cover K may then be locked in place on the tray T by pushing the cover top wall panel 50 tuck flap 54 down into tray top panel opening 57.

Also, if desired, the tray side wall panel lock tabs 62 may be pushed into the aligned openings formed by the related lock tabs of the cover side wall panels.

Thus, it should be appreciated that the invention provides a shallow depth tray type container with hinged cover that is relatively inexpensive to produce and can be manually erected, filled, closed, and locked easily and quickly by an operator.

What is claimed is:

1. An improved closure arrangement for a tray type container with hinged cover, said container being formed from a unitary blank of foldable sheet material, such as paperboard, and comprising:

(a) a tray including a bottom wall panel having a front wall panel, a rear wall panel, and side wall panels foldably joined to front, rear, and side edges thereof and upstanding therefrom;

(b) a top panel foldably joined, at its front edge, to an upper edge of said tray front wall panel and disposed to extend rearwardly therefrom;

(c) said tray side wall panels having front and rear corner flaps foldably joined to front and rear edges thereof and being disposed to be folded inwardly 90 degrees to lie against inner faces of said tray front and rear wall panels, respectively;

(d) said front corner flaps each including integral upper and lower lock tabs extending upwardly and downwardly therefrom and adapted to be received within related openings in said tray top panel and bottom wall panel, respectively, to provide interlocking engagement between said front wall panel and said side wall panels at front corners of said tray;

(e) each of said front corner flaps having, extending laterally thereacross, a score line arranged and disposed to allow a portion of said corner flap to be deflected, as its related side wall panel is canted inwardly, to facilitate insertion of said corner flap lock tabs into receiving openings of said tray top panel and bottom wall panel;

(f) a cover including a top wall panel having a rear edge foldably joined to an upper edge of said tray rear wall panel and having a pair of side wall panels foldably joined to opposed side edges thereof and depending therefrom;

(g) said cover top wall panel having, foldably joined to a front edge thereof, a relatively narrow tuck flap adapted to be received within a related opening in said tray top panel to lock said tray and cover in a closed condition.

2. A closure arrangement according to claim 1, wherein said cover top wall panel has a plurality of integral, forwardly projecting, lock tabs arranged and disposed for engagement with an upper edge of said tray front wall panel.

3. A closure arrangement according to claim 2, wherein said cover top wall lock tabs include a center and two side tabs arranged and disposed to be received in related recesses in said tray front wall panel upper edge.

4. A closure arrangement according to claim 1, wherein said front corner flap score is positioned in a lower portion of said front corner flap.

5. A closure arrangement according to claim 4, wherein said front corner flap score extends inwardly and upwardly from a lower outer corner of said corner flap at an acute angle with said tray bottom wall panel.

6. A closure arrangement according to claim 1, wherein said side wall panel rear corner flaps are free from interlocking engagement with said tray rear, bottom, and side wall panels and said cover top wall panel.

7. A closure arrangement according to claim 1, wherein said cover side wall panels have centrally disposed recesses in lower edges thereof and are arranged and disposed to fit snugly within said tray side wall panels when said container is closed.

8. An improved closure arrangement for a tray type container with hinged cover, said container being formed from a unitary blank of foldable sheet material, such as paperboard, and comprising:

(a) a tray including a bottom wall panel having a front wall panel, a rear wall panel, and side wall panels foldably joined to front, rear, and side edges thereof and upstanding therefrom;

(b) a top panel foldably joined, at its front edge, to an upper edge of said tray front wall panel and disposed to extend rearwardly therefrom;

(c) said tray side wall panels having front and rear corner flaps foldably joined to front and rear edges thereof and being disposed to be folded inwardly 90 degrees to lie against inner faces of said tray front and rear wall panels, respectively;

(d) said front corner flaps each including integral upper and lower lock tabs extending upwardly and downwardly therefrom and adapted to be received within related openings in said tray top panel and bottom wall panel, respectively, to provide interlocking engagement between said front wall panel and said side wall panels at front corners of said tray;

(e) each of said front corner flaps having, extending laterally thereacross, a score line arranged and disposed to allow a portion of said corner flap to be deflected, as its related side wall panel is canted inwardly, to facilitate insertion of said corner flap lock tabs into receiving openings of said tray top panel and bottom wall panel;

(f) a cover including a top wall panel having a rear edge foldably joined to an upper edge of said tray rear wall panel and having a pair of side wall panels foldably joined to opposed side edges thereof and depending therefrom;

(g) said tray and cover side wall panels each having formed therein aligned sets of lock tabs adapted to be moved into interlocking engagement with each other to lock said tray and cover in a closed condition.

9. A closure arrangement according to claim 8, wherein said cover top wall panel has a plurality of integral, forwardly projecting, lock tabs arranged and disposed for engagement with an upper edge of said tray front wall panel.

10. A closure arrangement according to claim 9, wherein said cover top wall lock tabs include a center and two side tabs arranged and disposed to be received in related recesses in said tray front wall panel upper edge.

11. A closure arrangement according to claim 8, wherein said front corner flap score is positioned in a lower portion of said front corner flap.

12. A closure arrangement according to claim 11, wherein said front corner flap score extends inwardly and upwardly from a lower outer corner of said corner flap at an acute angle with said tray bottom wall panel.

13. A closure arrangement according to claim 8, wherein said side wall panel rear corner flaps are free from interlocking engagement with said tray rear, bottom, and side wall panels and said cover top wall panel.

14. An improved closure arrangement for a tray type container with hinged cover, said container being formed from a unitary blank of foldable sheet material, such as paperboard, and comprising:

(a) a tray including a bottom wall panel having a front wall panel, a rear wall panel, and side wall panels foldably joined to front, rear, and side edges thereof and upstanding therefrom;

(b) a top panel foldably joined, at its front edge, to an upper edge of said tray front wall panel and disposed to extend rearwardly therefrom;

(c) said tray side wall panels having front and rear corner flaps foldably joined to front and rear edges thereof and being disposed to be folded inwardly 90 degrees to lie against inner faces of said tray front and rear wall panels, respectively;

(d) said front corner flaps each including integral upper and lower lock tabs extending upwardly and downwardly therefrom and adapted to be received within related openings in said tray top panel and bottom wall panel, respectively, to provide interlocking engagement between said front wall panel and said side wall panels at front corners of said tray;

(e) each of said front corner flaps having, extending laterally thereacross, a score line arranged and disposed to allow a portion of said corner flap to be deflected, as its related side wall panel is canted inwardly, to facilitate insertion of said corner flap lock tabs into receiving openings of said tray top panel and bottom wall panel;

(f) a cover including a top wall panel having a rear edge foldably joined to an upper edge of said tray rear wall panel and having a pair of side wall panels foldably joined to opposed side edges thereof and depending therefrom;

(g) said tray and cover including means adapted to be moved into interlocking engagement with each other to lock said tray and cover in a closed condition.

15. A closure arrangement according to claim 14, wherein said cover top wall panel has a plurality of integral, forwardly projecting, lock tabs arranged and disposed for engagement with an upper edge of said tray front wall panel.

16. A closure arrangement according to claim 15, wherein said cover top wall lock tabs include a center and two side tabs arranged and disposed to be received in related recesses in said tray front wall panel upper edge.

17. A closure arrangement according to claim 14, wherein said front corner flap score is positioned in a lower portion of said front corner flap.

18. A closure arrangement according to claim 17, wherein said front corner flap score extends inwardly and upwardly from a lower outer corner of said corner flap at an acute angle with said tray bottom wall panel.

19. A closure arrangement according to claim 14, wherein said side wall panel rear corner flaps are free from interlocking engagement with said tray rear, bottom, and side wall panels and said cover top wall panel.

20. A closure arrangement according to claim 14, wherein said cover side wall panels have centrally disposed recesses in lower edges thereof and are arranged and disposed to fit snugly within said tray side wall panels when said container is closed.

* * * * *